US009939756B1

(12) United States Patent
Takahashi

(10) Patent No.: US 9,939,756 B1
(45) Date of Patent: Apr. 10, 2018

(54) IMAGE FORMING APPARATUS AND METHOD FOR PREVENTING TONER SCATTERING IN AN IMAGE FORMING APPRATUS

(71) Applicants: KABUSHIKI KAISHA TOSHIBA, Tokyo (JP); TOSHIBA TEC KABUSHIKI KAISHA, Tokyo (JP)

(72) Inventor: Nobuaki Takahashi, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/391,619

(22) Filed: Dec. 27, 2016

(51) Int. Cl.
*G03G 15/08* (2006.01)

(52) U.S. Cl.
CPC ..... *G03G 15/0812* (2013.01)

(58) Field of Classification Search
CPC ..... G03G 15/0812; G03G 15/0942; G03G 15/0928
See application file for complete search history.

(56) References Cited

U.S. PATENT DOCUMENTS 6,411,788 B1 * 6/2002 Ogasawara ..... G03G 15/0898 399/397
2014/0334851 A1 11/2014 Izumi
2015/0063862 A1 * 3/2015 Hayashi ..... G03G 15/0942 399/103
2016/0370754 A1 * 12/2016 Goda ..... G03G 15/0898
2017/0003619 A1 * 1/2017 Kato ..... G03G 15/0812

* cited by examiner

*Primary Examiner* — Francis Gray
(74) *Attorney, Agent, or Firm* — Patterson & Sheridan, LLP

(57) ABSTRACT

According to an embodiment, an image forming apparatus includes a housing, a developing roller, and a photosensitive drum. The developing roller includes an image area and a pair of non-image areas. The image area extends along an axial direction the developing roller. The non-image areas are provided on both sides in the axial direction with respect to the image area. The image forming apparatus further includes a regulating member. The regulating member covers a gap in positions which are aligned over the non-image area. The regulating member regulates air flow toward sides of the image area in the axial direction.

20 Claims, 5 Drawing Sheets

IMAGE FORMING APPARATUS AND METHOD FOR PREVENTING TONER SCATTERING IN AN IMAGE FORMING APPRATUS

FIELD

Embodiments described herein relate generally to an image forming apparatus.

BACKGROUND

In an image forming apparatus, such as a copy machine or a printer, toner is scattered in the apparatus from a developing unit of an image forming section which is included in the image forming apparatus. The scattered toner is attached to a gear or the like, and becomes a cause of failure. In order to reduce the scattered toner, it is necessary to take measures to provide a duct for withdrawing the scattered toner, a filter and a fan which are provided in the duct. However, in a case in which components, such as the duct, the filter, and the fan, are provided, there is a possibility that a size of the apparatus increases.

DETAILED DESCRIPTION

According to an embodiment, an image forming apparatus includes a housing that includes an opening and contains a developer; a developing roller that is rotatably disposed in the housing and includes a portion which is exposed by the opening; and a photosensitive drum that is disposed parallel to the developing roller and facing the exposed portion of the developing roller, is rotatable in a predetermined rotation direction, faces a peripheral portion of the housing, and defines a gap between the housing and the photosensitive drum and between the developing roller and the photosensitive drum, wherein the developing roller includes an image area that extends along an axial direction of the developing roller, and that supplies the developer to an area of a surface of the photosensitive drum where a toner image is formed; and a pair of non-image areas that are provided on both sides in the axial direction with respect to the image area, and wherein the image forming apparatus further includes regulating members attached to the housing and covering the gap in positions which are aligned over at least one non-image area of the pair of non-image areas, and which regulate air flow toward sides of the image area in the axial direction.

Hereinafter, an image forming apparatus according to an embodiment will be described with reference to the accompanying drawings.

Figure 1:
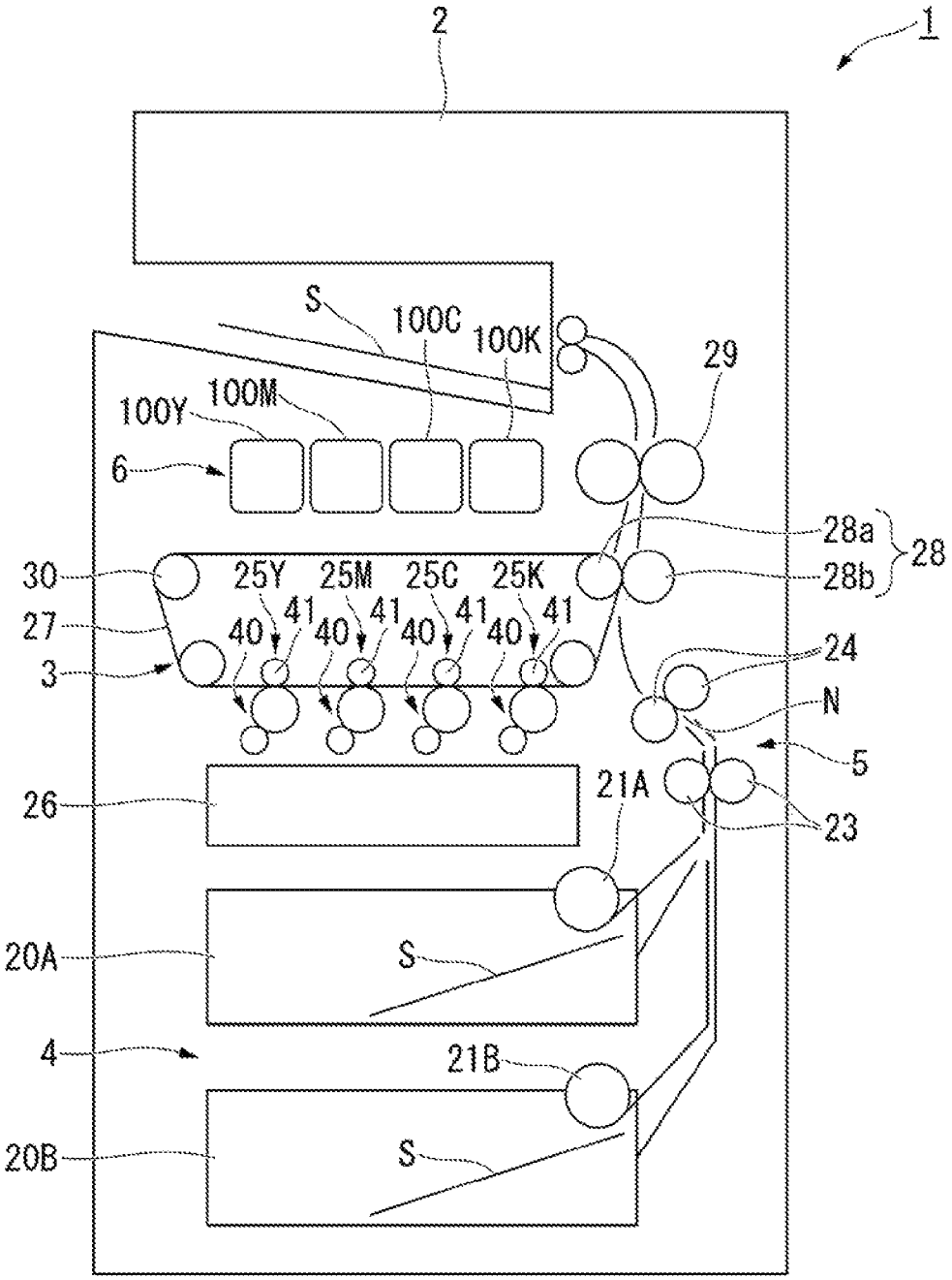
FIG. 1 is a schematic diagram illustrating an example of an image forming apparatus according to an embodiment.

FIG. 1 is a schematic diagram illustrating an example of an image forming apparatus according to an embodiment.

As illustrated in FIG. 1, an image forming apparatus 1 includes a scanner section 2, a printer section 3, a sheet containing section 4, a transfer section 5, and a toner propagating section 6. Hereinafter, description will be performed while it is assumed that the image forming apparatus 1 is in a state of being placed on a horizontal surface. In addition, a side of the image forming apparatus 1, which is illustrated in FIG. 1, is referred to as a front side, and an opposite side is referred to as a rear side.

The scanner section 2 reads image information of a copy object as brightness and darkness of light. The scanner section 2 sends the read image data to the printer section 3.

The printer section 3 forms an image (hereinafter, referred to as "a toner image") using a developer, which includes a toner or the like, based on the image data received from the scanner section 2 or an external device such as a client PC. The printer section 3 transfers the toner image onto a surface of the sheet S. The printer section 3 fixes the toner image on the sheet S by applying heat and pressure to the toner image on the surface of the sheet S.

The sheet containing section 4 supplies the sheet S to the printer section 3 one by one. The sheet containing section 4 includes a plurality of paper cassettes 20A and 20B. Each of the paper cassettes 20A and 20B stores the sheet S having a size and a type which are set in advance, respectively. The paper cassettes 20A and 20B include pick-up rollers 21A and 21B, respectively. Each of the pick-up rollers 21A and 21B extracts the sheet S one by one from each of the paper cassettes 20A and 20B. The pick-up rollers 21A and 21B supply the extracted sheet S to the transfer section 5.

The transfer section 5 includes transfer rollers 23 and resist rollers 24. The transfer section 5 transfers the sheet S, which is supplied from the pick-up rollers 21A and 21B, to the resist rollers 24. The resist rollers 24 transfer the sheet S according to a timing in which the printer section 3 transfers the toner image to the sheet S. The transfer rollers 23 butt the tip of the sheet S in a transfer direction to a nip N of the resist rollers 24. The transfer rollers 23 adjust the position of the tip of the sheet S in the transfer direction by bending the sheet S. The resist rollers 24 match the tip of the sheet S, which is sent out from the transfer rollers 23, in the nip N. Furthermore, the resist rollers 24 transfer the sheet S toward a transfer section 28 which will be described later.

Toner cartridges 100Y, 100M, 100C, and 100K, which contain toners, are mounted in the toner propagating section 6. The toner cartridges 100Y, 100M, 100C, and 100K contain respective colors of yellow, magenta, cyan, and black, respectively.

Hereinafter, the printer section 3 will be described in detail.

The printer section 3 includes image forming sections 25Y, 25M, 25C, and 25K, an exposure section 26, an intermediate transfer belt 27, the transfer section 28, and a fixing unit 29.

Each of the image forming sections 25Y, 25M, 25C, and 25K forms the toner image, which is transferred to the sheet S, on the intermediate transfer belt 27. The intermediate transfer belt 27 is an endless belt. Tension is given to the intermediate transfer belt 27 by a plurality of rollers which come into contact with the inner surface of the intermediate transfer belt 27. The intermediate transfer belt 27 is stretched to provide a flat surface. The inner surface of the intermediate transfer belt 27 comes into contact with a supporting roller 28*a* and a transfer belt roller 30 at positions which are separated to a maximum distance in a stretching direction.

The supporting roller 28*a* is a portion of the transfer section 28 which will be described below. The supporting roller 28*a* guides the intermediate transfer belt 27 to a secondary transfer position.

The transfer belt roller 30 guides the intermediate transfer belt 27 to a cleaning position.

On the lower side of the intermediate transfer belt 27, the image forming sections 25Y, 25M, 25C, and 25K are arranged in this order from the transfer belt roller 30 toward the transfer section 28. The image forming sections 25Y, 25M, 25C, and 25K are arranged in an area between the transfer belt roller 30 and the supporting roller 28*a* while being separated from each other. Meanwhile, the respective image forming sections 25Y, 25M, 25C, and 25K are formed similarly. In the description of configurations of the image forming sections 25Y, 25M, 25C, and 25K below, the image forming section 25Y will be described as an example.

The image forming section 25Y includes an image forming unit 40 and a primary transfer roller 41.

Figure 2:
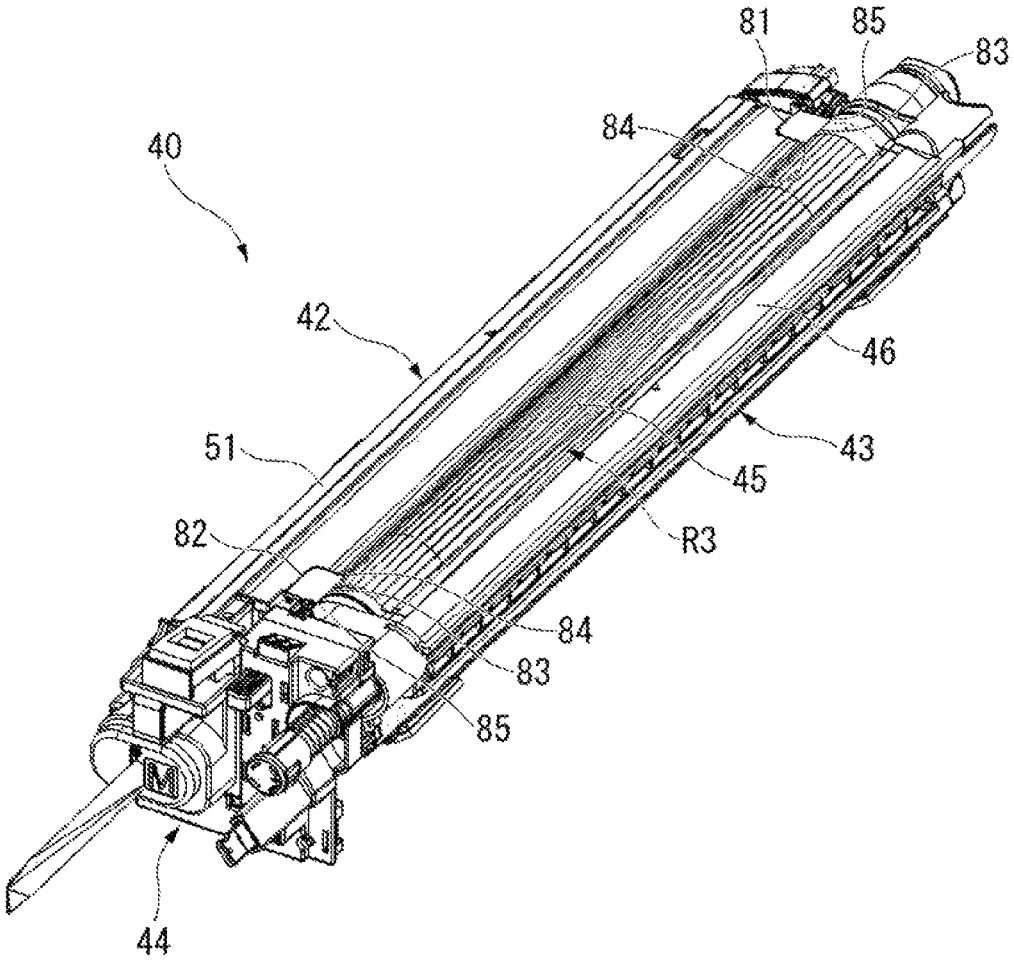
FIG. 2 is a perspective diagram illustrating an image forming unit according to an embodiment.

FIG. 2 is a perspective diagram illustrating the image forming unit according to the embodiment.

As illustrated in FIG. 2, the image forming unit 40 includes a developer unit 42, a drum unit 43, a cover unit 44, and a pair of regulating members 81 and 82.

Figure 3:
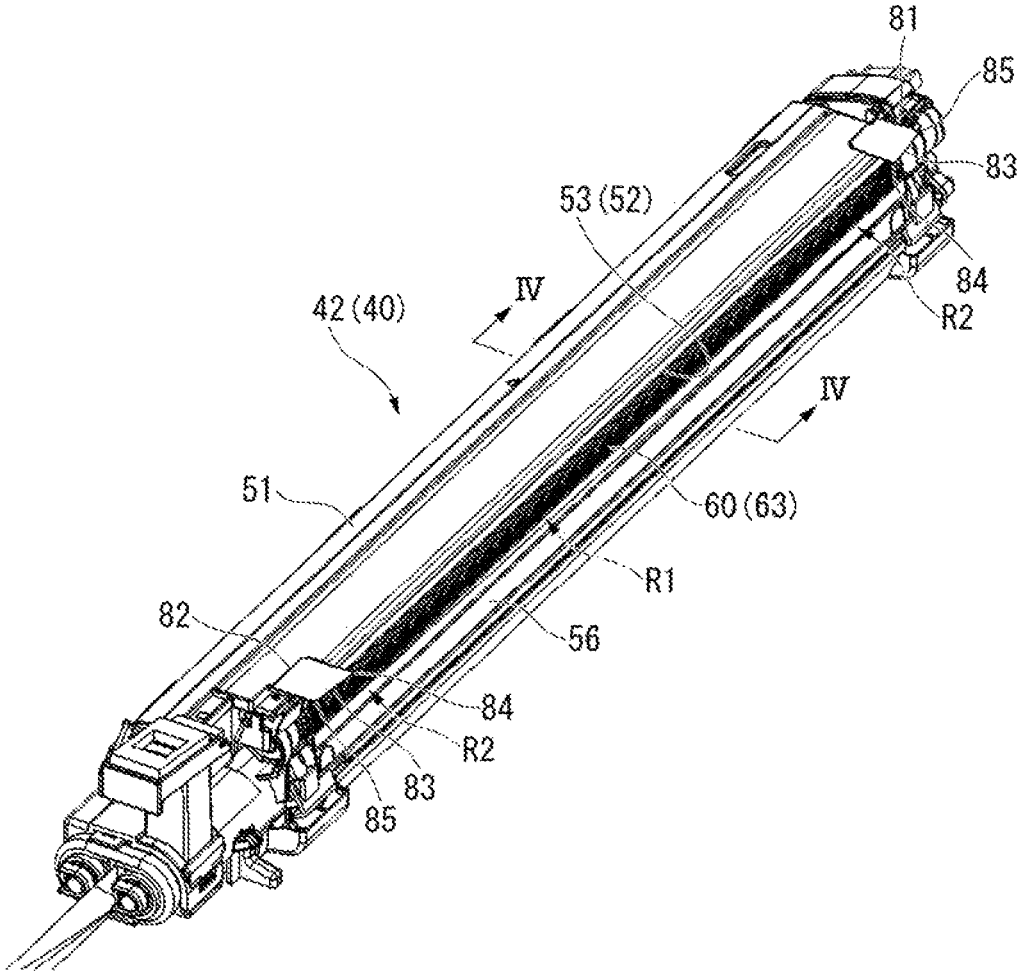
FIG. 3 is a perspective diagram illustrating a developer unit according to an embodiment.
Figure 4:
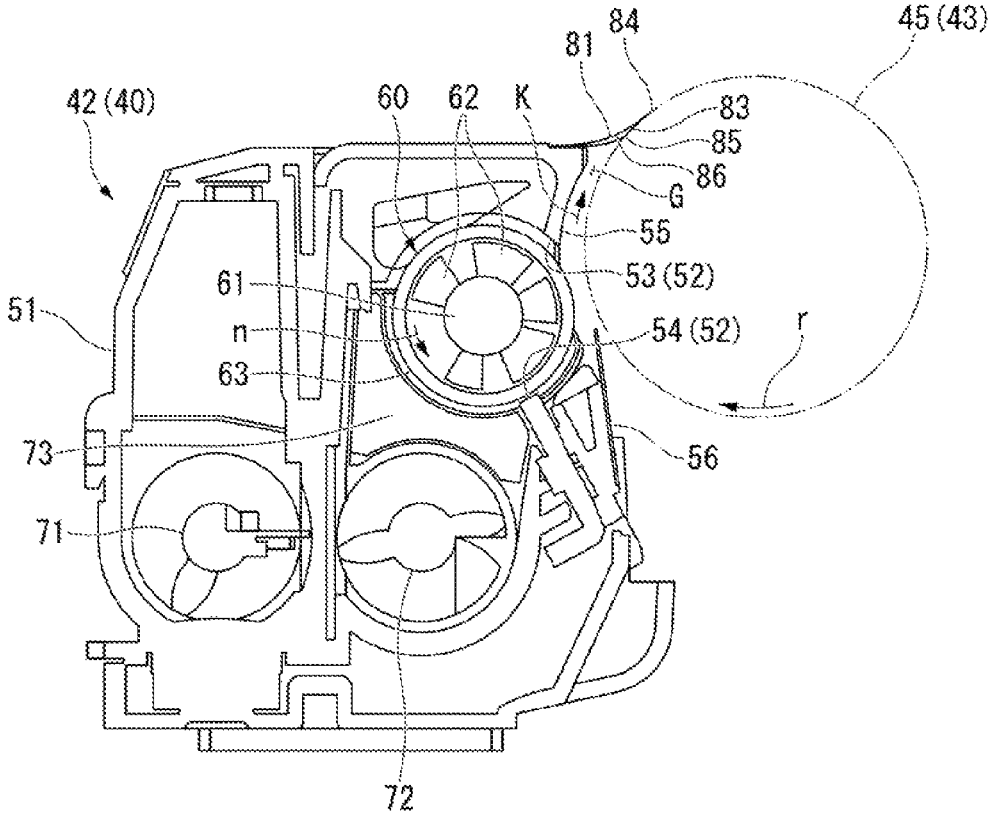
FIG. 4 is a cross-sectional diagram illustrating a cross-section taken along a line IV-IV of FIG. 3.

FIG. 3 is a perspective diagram illustrating the developer unit according to the embodiment. FIG. 4 is a cross-sectional diagram illustrating a portion taken along a line IV-IV of FIG. 3.

As illustrated in FIG. 4, the developer unit 42 supplies the toner to a surface of a photosensitive drum 45, which will be described below, of the drum unit 43. The developer unit 42 includes a housing 51, a developing roller 60, a first mixer 71, a second mixer 72, and a pair of magnetic plates 73.

The housing 51 is formed in a hollow shape and includes an opening 52. The housing 51 contains a developer. The developer includes the toner and carriers. The carriers are acquired by performing, for example, resin coating on a surface of iron powder, oxidation-treated iron powder, ferrite powder, a nickel powder, or the like. In the housing 51, a first mixer 71 and a second mixer 72 are disposed. The first mixer 71 and the second mixer 72 stir the developer in the housing 51.

The developing roller 60 is provided on the upper side of the second mixer 72. The developing roller 60 is rotatably provided in the housing 51. The developing roller 60 rotates around a shaft along an axis from the front to the rear of the developer unit 42. Hereinafter, the axial direction of the rotation center of the developing roller 60 is simply referred to as the axial direction, and the developing roller 60, in which a direction perpendicular to the axial direction is referred to as the radial direction, rotates in a rotation direction n.

Figure 5:
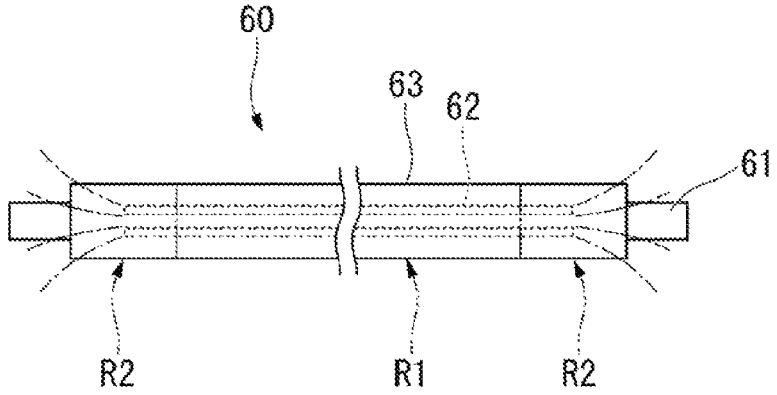
FIG. 5 is a schematic diagram illustrating a configuration of a developing roller.

FIG. 5 is a schematic diagram illustrating a configuration of the developing roller.

As illustrated in FIG. 5, the developing roller 60 includes a shaft section 61, a plurality of magnetic pole sections 62, and a sleeve 63.

The shaft section 61 extends along the axial direction. The shaft section 61 is fixed to the housing 51 (refer to FIG. 4). The plurality of magnetic pole sections 62 are, for example, magnets. The plurality of magnetic pole sections 62 extend along the axial direction. The plurality of magnetic pole sections 62 are fixed to the shaft section 61.

The sleeve 63 is formed to have a cylindrical shape which extends along the axial direction. The shaft section 61 and the plurality of magnetic pole sections 62 are provided in the sleeve 63. The sleeve 63 is rotatably coupled to a driving source (not illustrated).

As illustrated in FIG. 4, a portion of the developing roller 60 is exposed to the outside of the housing 51 through the opening 52 of the housing 51. The opening 52 extends along the axial direction. The opening 52 causes a portion of the sleeve 63 of the developing roller 60 to be exposed over the whole length in the axial direction. An upper end 53 of the opening 52 linearly extends along the axial direction. A gap is formed between the upper end 53 of the opening 52 and the sleeve 63. A lower end 54 of the opening 52 linearly extends along the axial direction. A gap is formed between the lower end 54 of the opening 52 and the sleeve 63. A shield section 56 is provided on the outside of the lower end 54 of the opening 52.

As illustrated in FIG. 5, the developing roller 60 includes an image area R1 and a pair of non-image areas R2. The image area R1 is formed at the center of the surface of the developing roller 60 with respect to the axial direction. In the image area R1, the plurality of magnetic pole sections 62 are disposed along the entire length of the image area R1 in the axial direction. In the image area R1, magnetic fields are uniformly formed along the whole length of the image area R1 in the axial direction, on a surface corresponding to the portion which is exposed in the opening 52 of the housing 51 (refer to FIG. 4) along the entire length of the developing roller 60 (see FIG. 3). The non-image areas R2 are respectively provided on both sides of the image area R1 in the axial direction. In the respective non-image areas R2, ends of the plurality of magnetic pole sections 62 are disposed respectively. In the non-image areas R2, magnetic force lines, which are expressed by dashed lines in the drawing, extend toward the outside in the axial direction.

As illustrated in FIG. 4, the magnetic plates 73 are formed of a magnetic material. Each of the magnetic plates 73 is formed in a plate shape with a surface facing in the axial direction. Each of the magnetic plates 73 is disposed between the developing roller 60 and the second mixer 72 near an end of the developing roller 60. Each of the magnetic plates 73 is formed in a shape which evades the developing roller 60 and the second mixer 72 when viewed along the axial direction. A portion of an outer edge of each of the magnetic plates 73 runs along a surface of the developing roller 60. Each of the magnetic plates 73 is disposed in a position which overlaps ends of the magnetic pole sections 62 of the developing roller 60 when viewed along the radial direction.

As illustrated in FIG. 2, the drum unit 43 includes the photosensitive drum 45, and a maintaining body 46 which maintains the photosensitive drum 45.

As illustrated in FIG. 2 and FIG. 3, the photosensitive drum 45 is disposed in a position which faces a portion of the developing roller 60 that is exposed by the opening 52 of the housing 51. The photosensitive drum 45 is disposed to be parallel to the developing roller 60. The photosensitive drum 45 is rotatable. A surface of the photosensitive drum 45 includes a toner image forming area R3. A toner image is formed in the toner image forming area R3. A position of the toner image forming area R3 in the axial direction coincides with a position of the image area R1 of the developing roller 60 in the axial direction. A dimension of the toner image forming area R3 in the axial direction is equal to a dimension of the image area R1 (refer to FIG. 5) of the developing roller 60 in the axial direction.

As illustrated in FIG. 4, the photosensitive drum 45 rotates in a rotation direction r. The peripheral portion 55 of the opening 52 of the housing 51 has a gap G in a downstream side of the opening 52 in the rotation direction r in a position closest to the developing roller 60. The gap G opens toward the downstream side in the rotation direction r.

As illustrated in FIG. 2, a cover unit 44 is disposed at ends of the developer unit 42 and the drum unit 43 in the axial direction. The cover unit 44 fixes the developer unit 42 and the drum unit 43 to an apparatus main body.

As illustrated in FIG. 3 and FIG. 4, the regulating members 81 and 82 extend from the housing 51 of the developer unit 42. The regulating members 81 and 82 respectively cover the gap G from the downstream side in the rotation direction r. The regulating members 81 and 82 regulate air flowing in the gap G along the rotation direction r toward sides of the image area R1 in the axial direction.

As illustrated in FIG. 3, the regulating member 81 is disposed in a position which overlaps the non-image area R2 on one side (rear side) of the developing roller 60 in the axial direction, as can be seen when viewed along the radial direction. The regulating member 81 is disposed in a position which overlaps an end (refer to FIG. 5) of one side (rear side) of the magnetic pole sections 62 in the axial direction, which can be seen when viewed along the radial direction. The regulating member 82 is disposed in a position which overlaps the non-image area R2 on the other side (front side) of the developing roller 60 in the axial direction, as can be seen when viewed along the radial direction. The regulating member 82 is disposed in a position which overlaps an end (refer to FIG. 5) of the other side (front side) of the magnetic pole sections 62 in the axial direction, as can be seen when viewed along the radial direction. The regulating members 81 and 82 are disposed plane-symmetrically with respect to a virtual plane which is perpendicular to the axial direction. In description below, the regulating member 81 will be mainly described. In the regulating member 82, the same reference symbols are indicated to configurations which are the same as in the regulating member 81.

Figure 6:
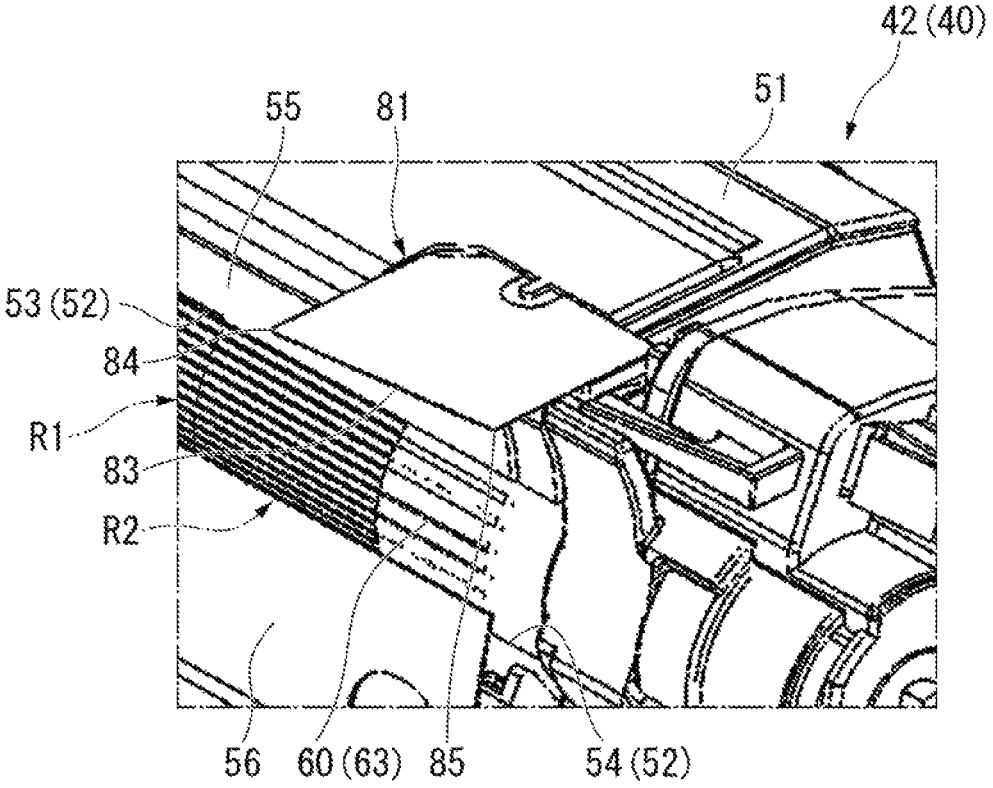
FIG. 6 is an enlarged perspective diagram illustrating a portion of the image forming unit of FIG. 2.

FIG. 6 is an enlarged perspective diagram illustrating the image forming unit according to the embodiment.

As illustrated in FIG. 6, the regulating member 81 is formed of a flexible sheet-shaped member. The regulating member 81 is formed of an insulating material. The regulating member 81 is formed of a urethane sheet. The regulating member 81 is fixed to an upper surface of the housing 51 by a double sided tape or the like. An apex edge 83 of the regulating member 81 obliquely extends in the axial direction. The apex edge 83 of the regulating member 81 includes a first end 84 on a side of the image area R1 in the axial direction, and a second end 85 on a side opposite to the first end 84.

As illustrated in FIG. 4, the regulating member 81 horizontally protrudes from the housing 51 toward the photosensitive drum 45, and extends toward the downstream side in the rotation direction r. The apex edge 83 of the regulating member 81 comes into contact with the surface of the photosensitive drum 45. The first end 84 of the apex edge 83 of the regulating member 81 comes into contact with the surface of the photosensitive drum 45 on the downstream side in the rotation direction r of the second end 85. A surface of the regulating member 81, which faces the upstream side in the rotation direction r, is an inclined plane 86 which is inclined with respect to the axial direction. The inclined plane 86 faces a side of the image area R1 from the non-image areas R2 in the axial direction as the inclined plane 86 faces the downstream side from the upstream side in the rotation direction r.

The primary transfer roller 41 illustrated in FIG. 1 may be an electrically-conductive roller. The primary transfer roller 41 presses the photosensitive drum 45 (refer to FIG. 2) through the intermediate transfer belt 27. In addition, a transfer bias voltage is applied to the primary transfer roller 41. Therefore, the toner image is transferred (primarily transferred) to the intermediate transfer belt 27.

The respective developer units 42 of the image forming sections 25Y, 25M, 25C, and 25K contain yellow, magenta, cyan, and black toners. The toners contained in the respective developing units 42 are supplied from the toner cartridges 100Y, 100M, 100C, and 100K.

As illustrated in FIG. 1 and FIG. 2, the exposure section 26 faces the photosensitive drums 45 of the image forming sections 25Y, 25M, 25C, and 25K. The exposure section 26 irradiates the toner image forming area R3 of the photosensitive drum 45 with laser light whose emission is controlled based on the image information. The pieces of yellow, magenta, cyan, and black image information are supplied to the exposure section 26. The exposure section 26 irradiates the respective charged photosensitive drums 45 with laser light based on the pieces of yellow, magenta, cyan, and black image information. The exposure section 26 forms an electrostatic latent image in the toner image forming area R3 of the photosensitive drum 45 based on the image information.

The image forming section 25Y develops the electrostatic latent image formed by laser light from the exposure section 26 by a yellow toner. The image forming section 25Y forms a yellow toner image in the toner image forming area R3 of the photosensitive drum 45. The image forming section 25M develops the electrostatic latent image formed by laser light from the exposure section 26 by a magenta toner. The image forming section 25M forms a magenta toner image in the toner image forming area R3 of the photosensitive drum 45. The image forming section 25C develops the electrostatic latent image formed by laser light from the exposure section 26 by a cyan toner. The image forming section 25C forms a cyan toner image in the toner image forming area R3 of the photosensitive drum 45. The image forming section 25K develops the electrostatic latent image formed by laser light from the exposure section 26 by the black toner. The image forming section 25K forms a black toner image in the toner image forming area R3 of the photosensitive drum 45.

The image forming sections 25Y, 25M, 25C, and 25K transfer (primarily transfer) the toner images of the toner image forming area R3 of the photosensitive drum 45 onto the intermediate transfer belt 27. The image forming sections 25Y, 25M, 25C, and 25K apply a transfer bias to the toner images in the respective primary transfer positions. The image forming sections 25Y, 25M, 25C, and 25K superimpose the respective color toner images and transfer the images on the intermediate transfer belt 27. The image forming sections 25Y, 25M, 25C, and 25K form the color toner images on the intermediate transfer belt 27.

As illustrated in FIG. 1, the transfer section 28 is disposed on the downstream side in the intermediate transfer belt 27 of the image forming section 25K. The transfer section 28 transfers the toner image on the intermediate transfer belt 27 onto the surface of the sheet S in the secondary transfer position. The secondary transfer position is a position in which the supporting roller 28*a* faces a secondary transfer roller 28*b*. The transfer section 28 applies a transfer bias, which is controlled using transfer current, to the secondary transfer position. The transfer section 28 transfers the toner image on the intermediate transfer belt 27 to the sheet S using the transfer bias.

The fixing unit 29 fixes the toner image on the surface of the sheet S to the sheet S using heat and pressure which are applied to the sheet S.

Subsequently, an operation of the image forming apparatus 1 will be described.

As illustrated in FIG. 5, in the non-image areas R2 of the developing roller 60, the magnetic force lines, which are expressed by the dashed lines in the drawing, extend toward the outside in the axial direction. Therefore, a developer which is attached to the non-image areas R2 of the developing roller 60 is scattered.

As illustrated in FIG. 4, in a case in which the photosensitive drum 45 rotates in the rotation direction r, airflow K is generated in the gap G between the opening peripheral portion 55 and the photosensitive drum 45. The airflow K runs along the rotation direction r. Air which flows in the gap G entrains the toner which is scattered from the non-image areas R2 of the developing roller 60 by the divergent magnetic field lines shown in FIG. 5. The gap G is covered by the pair of regulating members 81 and 82 from the downstream side in the rotation direction r. The regulating members 81 and 82 regulate air which flows in the gap G along the rotation direction r, and steers the air toward the sides of the image area R1 in the axial direction and toward the non-image areas R2. Therefore, the flow direction of the airflow K is steered to the side of the image area R1 in the axial direction and across to the non-image areas R2.

Toner entrained in the airflow by scattering from the sides of the image area R1 or the non-image areas R2 is excess, and is not intended to form part of an image on the intermediate transfer belt 27. Air which includes the toner is steered toward the non-image areas R2. The entrained toner is deposited on areas of the transfer belt 27 corresponding to the non-image areas R2 of the developing roller 60. The toner is transferred to a position on the intermediate transfer belt 27 that corresponds to the non-image areas R2 of the developing roller 60. The toner then flows to a waste toner box by operation of a cleaning unit (not shown) without affecting an image to be printed. Therefore, the toner scattered from the non-image areas R2 of the developing roller 60 flows from the gap G toward the outside in the axial direction, is deposited on the photosensitive drum 45, is moved toward the ends of the developing roller 60, is transferred to the intermediate transfer belt 27, and is routed to a waste toner box without contaminating other units in the apparatus.

As described above, in the embodiment, the regulating members 81 and 82 are included, which regulate air, which flows in the gap G along the rotation direction r, toward the sides of the image area R1 in the axial direction. With the configuration, it is possible to suppress the developer (including toner), which is entrained in the air that flows in the gap G along the rotation direction r, from flowing out from the gap G toward the outside in the axial direction. Accordingly, it is possible to suppress the toner which is included in the developer from contaminating other units in the apparatus with simple configuration. Accordingly, it is possible to suppress the size of the apparatus from increasing and component costs from rising.

The regulating members 81 and 82 are disposed in positions which align over the pair of non-image areas R2 when viewed along the radial direction. Therefore, it is possible to suppress the toner from flowing out from the gap G toward the outside in the axial direction on both sides in the axial direction. Accordingly, it is possible to suppress the toner from contaminating other units in the apparatus.

The regulating members 81 and 82 are disposed in positions which overlap the ends of the magnetic pole sections 62 when viewed from the radial direction. Therefore, it is possible to effectively suppress the developer, which is scattered because the magnetic force lines extend from the ends of the magnetic pole sections 62 toward the outside in the axial direction, from flowing out from the gap G toward the outside in the axial direction. The regulating members 81 and 82 prevent such flow by directing the developer onto the photosensitive drum 45 before the developer flows from the gap G toward the outside in the axial direction.

Each of the regulating members 81 and 82 includes the inclined plane 86 which faces the side of the image area R1 from the sides of the non-image areas R2 in the axial direction as the inclined plane 86 faces the downstream side from the upstream side in the rotation direction r. Therefore, air, which flows in the gap G along the rotation direction r, impinges the inclined plane 86, so that the flow of the air is directed toward the sides of the image area R1 in the axial direction. Accordingly, it is possible to regulate air, which flows in the gap G along the rotation direction r, toward the sides of the image area R1 in the axial direction by the regulating members 81 and 82.

The apex edge 83 of each of the regulating members 81 and 82 comes into contact with the surface of the photosensitive drum 45. Therefore, it is possible to prevent air, which flows in the gap G along the rotation direction r, from passing through the gap between the apex edge 83 of each of the regulating members 81 and 82 and the photosensitive drum 45. Accordingly, it is possible to effectively suppress the toner entrained in the air, which flows in the gap G along the rotation direction r, from flowing out from the gap G toward the outside in the axial direction.

The flexibility of the regulating members 81 and 82 reduces a contact pressure between the regulating members 81 and 82 and the photosensitive drum 45. Accordingly, it is possible to prevent the surface of the photosensitive drum 45 from being damaged by the regulating members 81 and 82.

The first end 84, on a side of the image area R1 in the apex edge 83 of each of the regulating members 81 and 82, and the second end 85 of the apex edge 83, opposite the first end 84, come into contact with the surface of the photosensitive drum 45 on the downstream side in the rotation direction r. Therefore, it is possible to turn a surface of the regulating members 81 and 82 facing the photosensitive drum 45, and facing the upstream side in the rotation direction r, toward the sides of the image area R1. Accordingly, it is possible to form the inclined plane 86.

In addition, the regulating members 81 and 82 are formed of a urethane sheet. Therefore, it is possible to make the regulating members 81 and 82 flexible, reducing the contact pressure between the regulating members 81 and 82 and the photosensitive drum 45 and preventing damage to the surface of the photosensitive drum 45.

In addition, the regulating members 81 and 82 extend from the housing 51 toward the downstream side in the rotation direction r. Therefore, it is possible to prevent the regulating members 81 and 82, which come into contact with the surface of the photosensitive drum 45, from being bent or turned up by rotation of the photosensitive drum 45. Accordingly, it is possible to prevent a gap from being formed between the apex edge 83 of each of the regulating members 81 and 82 and the photosensitive drum 45. Accordingly, it is possible to suppress the toner which is entrained in the air, which flows in the gap G along the rotation direction r, from flowing out from the gap G toward the outside in the axial direction.

The regulating members 81 and 82 are formed of an insulating material. The intermediate transfer belt 27, to which the toner image is transferred from the photosensitive drum 45, has an electric potential with polarity opposite to that of the surface of the photosensitive drum 45. Because the regulating members 81 and 82 are electrically insulating, it is possible to prevent the regulating members 81 and 82 from acquiring an electric potential having the same polarity as the surface of the photosensitive drum 45, which prevents the toner image on the intermediate transfer belt 27 from being reversely transferred to the regulating members 81 and 82. Accordingly, it is possible to suppress contamination due to the toner in the apparatus.

Either of the regulating members 81 and 82 may be disposed in the same position in the axial direction as at least one non-image area R2 of the pair of non-image areas R2. The regulating members 81 and 82 may also be disposed in positions which do not overlap the magnetic pole sections 62 when viewed from the radial direction. The regulating members 81 and 82 may be formed as members separate from the housing 51, or may be formed integrally with the housing 51. The regulating members 81 and 82 may also be formed of an inflexible material to be able to regulate air which flows in the gap G. For example, the regulating members may be formed in advance with a shape which has an inclined plane.

According to at least one of the above-described embodiments, a regulating member is provided that regulates air, which flows in a gap along a rotation direction of a photosensitive drum, toward sides of an image area in an axial direction. With the configuration, it is possible to suppress the toner, taken in the air which flows in the gap along the rotation direction, from flowing out from the gap toward the outside in the axial direction. Accordingly, it is possible to suppress the toner which is included in the developer from contaminating other units in the apparatus developer with simple configuration. Accordingly, it is possible to suppress the size of the apparatus from increasing and the component costs from rising.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a housing that includes an opening and contains a developer;

a developing roller that is rotatably disposed in the housing and includes a portion which is exposed by the opening; and a photosensitive drum that is disposed parallel to the developing roller and facing the exposed portion of the developing roller with a gap therebetween, and is rotatable in a predetermined rotation direction, wherein the developing roller includes an image area that extends along an axial direction of the developing roller, and that supplies the developer to an area of a surface of the photosensitive drum where a toner image is formed; and a pair of non-image areas that are provided on both sides of the image area in the axial direction, and wherein the image forming apparatus further includes:

regulating members attached to the housing and covering the gap in positions which are aligned over at least one non-image area of the pair of non-image areas, and which generate an air flow in the gap toward sides of the image area in the axial direction.

2. The image forming apparatus according to claim 1, wherein the regulating members are respectively disposed in positions which are aligned over the pair of non-image areas.

3. The image forming apparatus according to claim 1, wherein the developing roller includes a plurality of magnetic pole sections that extend along the axial direction and end in the non-image areas, and wherein the regulating members are provided in positions which overlap ends of the magnetic pole sections.

4. The image forming apparatus according to claim 1, wherein each of the regulating members defines an inclined plane that faces a side of the image area in the axial direction.

5. The image forming apparatus according to claim 1, wherein each regulating member includes an apex edge that contacts the surface of the photosensitive drum.

6. The image forming apparatus according to claim 5, wherein each regulating member is formed of a flexible sheet-shaped member.

7. The image forming apparatus according to claim 6, wherein a first end of the apex edge, on a side of the image area in the axial direction, and a second end of the apex edge, opposite the first end, come into contact with the surface of the photosensitive drum.

8. The image forming apparatus according to claim 6, wherein each regulating member is formed of a urethane sheet.

9. The image forming apparatus according to claim 6, wherein each regulating member extends from the housing downstream in the predetermined rotation direction.

10. The image forming apparatus according to claim 1, wherein each regulating member is formed of an insulating material.

11. A method for preventing a toner from scattering in an image forming apparatus, comprising:

generating airflow with entrained toner in a gap between a portion of a housing and a photosensitive drum by rotating the photosensitive drum in a rotation direction;

changing, by a regulating member, a direction of the airflow in the gap to an axial direction of a developing roller toward sides of an image area of the developing roller;

depositing the toner at positions on an intermediate transfer belt corresponding to non-image areas of the developing roller;

causing the toner deposited on the intermediate transfer belt to flow in a waste toner box.

12. The method according to claim 11, wherein the regulating member is disposed in a position aligned over the non-image area.

13. The method according to claim 11, wherein the developing roller includes a plurality of magnetic pole sections extending along the axial direction of the developing roller and ending in the non-image areas, wherein the regulating member overlaps an end of a magnetic pole section.

14. The method according to claim 11, wherein the regulating member defines an inclined plane that faces a side of the image area in the axial direction, wherein the airflow in the gap changes direction by the inclined plane.

15. The method according to claim 11, further comprising contacting an apex edge of the regulating member with the surface of the photosensitive drum.

16. The method according to claim 15, wherein the regulating member is formed of a flexible sheet-shaped member.

17. The method according to claim 16, wherein a first end of the apex edge, on a side of the image area in the axial direction, and a second end of the apex edge, opposite the first end, contact the surface of the photosensitive drum.

18. The method according to claim 16, wherein the regulating member is formed of a urethane sheet.

19. The method according to claim 16, wherein the regulating member extends from the housing downstream in the rotation direction.

20. The method according to claim 11, wherein the regulating member is formed of an insulating material.

* * * * *